US007536149B2

(12) United States Patent
Nakajima et al.

(10) Patent No.: US 7,536,149 B2
(45) Date of Patent: May 19, 2009

(54) IMAGE FORMING APPARATUS

(75) Inventors: Hirofumi Nakajima, Hachioji (JP); Teruhiko Toyoizumi, Tachikawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 284 days.

(21) Appl. No.: 11/453,212

(22) Filed: Jun. 14, 2006

(65) Prior Publication Data

US 2007/0048051 A1 Mar. 1, 2007

(30) Foreign Application Priority Data

Aug. 1, 2005 (JP) ..... 2005-222664

(51) Int. Cl.
*G03G 15/00* (2006.01)

(52) U.S. Cl. ..... 399/382

(58) Field of Classification Search ..... 399/382
See application file for complete search history.

(56) References Cited

U.S. PATENT DOCUMENTS 7,062,214 B2 * 6/2006 Moriyama ..... 399/382

FOREIGN PATENT DOCUMENTS

JP 5-286619 A 11/1993

JP 10-250914 A 9/1998

* cited by examiner

*Primary Examiner*—Ren Yan
*Assistant Examiner*—Andy L Pham
(74) *Attorney, Agent, or Firm*—Frishauf, Holtz, Goodman & Chick, P.C.

(57) ABSTRACT

There is described an image forming apparatus, in which the recording medium and the insertion recording medium are conveyed in a state that they overlap each other. The image forming apparatus includes: an image forming section to form an image on a recording medium; a sheet tray on which an inserting sheet is stacked; a sheet overlapping section to make the recording medium and the inserting sheet overlap with each other; a first conveyance section to convey the recording medium from the image forming section to the sheet overlapping section; a second conveyance section to convey the inserting sheet from the sheet tray to the sheet overlapping section; and a third conveyance section to simultaneously convey the recording medium and the inserting sheet from the sheet overlapping section to a post-processing section. The post-processing section processes the recording medium and the inserting sheet conveyed by the third conveyance section.

8 Claims, 4 Drawing Sheets

IMAGE FORMING APPARATUS

This application is based on Japanese Patent Application No. 2005-222664 filed on Aug. 1, 2005 in Japanese Patent Office, the entire content of which is hereby incorporated by reference.

BACKGROUND OF THE INVENTION

The present invention relates to an image forming apparatus, which makes it possible to insert cover papers and/or insertion papers, for indicating positions of divided sections, into recording mediums on which images are already formed, in a predetermined order.

Recently, according to the expansion of the information network proliferated with the development of a digitization technique, it has become possible to easily obtain a large amount of the digital image information digitalized in an overwhelming mass mode. These digital image information are not only employed for displaying images on the displaying device coupled to the personal computer, but also employed for forming images on the recording mediums. In addition, a number of the latter cases are getting increase recently.

Accordingly, there has been demanded for the image forming apparatus to efficiently form the images based on the obtained image information onto the recording medium within a short time. Specifically, when various kinds of post processing, such as, a staple processing, a punch processing, a fold processing, a stamp processing, etc., are applied to the recording mediums, which are accepted from the image forming apparatus and on which the images are already formed, the post processing apparatus is so constituted that a next bunch of paper sheets, as the next volume of the recording mediums, can be accepted immediately after the post processing apparatus enters into a processable state.

However, when applying the post processing mentioned in the above to plural volumes of the recording mediums, in addition to the processing time required for conducting the post processing, such as the staple processing, etc., the conveying time, for conveying the bunch of paper sheets of the recording mediums from the inside of the post processing apparatus into the ejecting tray of the post processing apparatus, is also required. As a result, the total processing time of the post processing apparatus has become longer that that of the image forming apparatus.

Accordingly, to cope with the above, the operations of the image forming apparatus should be temporarily deactivated until the post processing operations for the recording mediums are completed. There has been a problem that the abovementioned fact has deteriorated the productivity of the image forming apparatus.

To overcome the abovementioned drawback, for instance, Patent Document 1 sets forth the technology of the image forming apparatus in which the first conveyance path for conveying a first paper sheet and the second conveyance path for conveying a second paper sheet are provided in parallel and the stopper is equipped at each conveying path or at the merging point of the first conveyance path and the second conveyance path so as to match the leading edges of the first paper sheet and the second paper sheet with each other and to convey both of them in an overlapped state.

Further, for instance, Patent Document 2 sets forth the technology of the image forming apparatus in which the first paper sheet passes through the first conveyance path and is butted against the stopper disposed at the merged conveyance path so as to correct its skew, while the second paper sheet passes through the second conveyance path and is butted against the same stopper as the above so as to correct its skew as well, and when the two paper sheets overlap with each other, the stopper is opened so that the bunch of paper sheets are conveyed to the post processing section through the conveyance path, and then, ejected onto the stacker section after the post processing are applied to the bunch of paper sheets.

[Patent Document 1]

Tokkaihei 5-286619 (Japanese Non-Examined Patent Publication)

[Patent Document 2]

Tokkaihei 10-250914 (Japanese Non-Examined Patent Publication)

Since the image forming apparatus, set forth in Patent Document 1 or Patent Document 2, employs the two different conveyance paths for conveying the recording mediums, on each of which the image is already formed, to the post processing apparatus, the abovementioned method would be effective for such the case that the recording mediums, on each of which the image is already formed, are conveyed one by one to the post processing apparatus so as not to lower the productivity of the image forming apparatus.

However, when the bunch of paper sheets of the recording mediums is shaped in a booklet, or the like, sometimes, a recording medium for insertion use (an insertion recording medium), being different from the recording medium on which the image is to be formed, would be inserted as a cover sheet of the booklet or a delimiting sheet for indicating the change of the contents of the booklet in the post processing apparatus, instead of only conveying the recording mediums on which the images are already formed by the image forming apparatus.

Accordingly, since Patent Document 1 or Patent Document 2 describes no methods nor considerations in regard to the technology not to lower the productivity of the image forming apparatus even in the case that the abovementioned insertion recording medium is employed as the above, there has been a problem that the technologies set forth in Patent Document 1 or Patent Document 2 could not be applied to the image forming apparatus combined to the post processing apparatus.

SUMMARY OF THE INVENTION

To overcome the abovementioned drawbacks in conventional image forming apparatus, it is an object of the present invention to provide an image forming apparatus, in which the recording medium and the insertion recording medium are conveyed in a state that they overlap each other and makes it possible to improve its productivity.

Accordingly, to overcome the cited shortcomings, the abovementioned object of the present invention can be attained by image forming apparatuses described as follow.

(1) An image forming apparatus comprising: an image forming section to form an image on a recording medium; a sheet tray on which an inserting sheet is stacked; a sheet overlapping section to make the recording medium and the inserting sheet overlap with each other; a first conveyance section to convey the recording medium from the image forming section to the sheet overlapping section; a second conveyance section to convey the inserting sheet from the sheet tray to the sheet overlapping section; and a third conveyance section to simultaneously convey the recording medium and the inserting sheet from the sheet overlapping section to a post-processing section; wherein the post-processing section processes the recording medium and the inserting sheet conveyed by the third conveyance section.

(2) The image forming apparatus of item 1, wherein the sheet overlapping section comprises: a pair of rollers to sandwich the recording medium and the inserting sheet; and a controlling section to control a rotation of the pair of rollers; wherein the controlling section stops the rotation of the pair of rollers so as to match leading edges of the recording medium and the inserting sheet with each other.

(3) The image forming apparatus of item 1, further comprising: a storage section to store first printing information of the recording medium and second printing information of the inserting sheet; a setting section to set analogous conditions with respect to the recording medium and the inserting sheet; and a determining section to compare the first printing information of the recording medium with the second printing information of the inserting sheet, so as to determine whether or not the first printing information and the second printing information are analogous to each other, based on the analogous conditions; wherein the sheet overlapping section makes the recording medium and the inserting sheet overlap with each other, when the determining section determines that the first printing information and the second printing information are analogous to each other.

(4) The image forming apparatus of item 3, wherein the analogous conditions includes at least one of a kind of sheet, a basis weight, and a size.

(5) The image forming apparatus of item 1, further comprising: a designation section to designate a page of the recording medium so as to overlap the inserting sheet and the recoding medium designated.

(6) An image forming apparatus comprising: an image forming section to form an image on a recording medium; a sheet tray on which an inserting sheet is stacked; a sheet overlapping section to make the recording medium and the inserting sheet overlap with each other; a first conveyance section to convey the recording medium from the image forming section to the sheet overlapping section; a second conveyance section to convey the inserting sheet from the sheet tray to the sheet overlapping section; a storage section to store first printing information of the recording medium and second printing information of the inserting sheet; a setting section to set analogous conditions with respect to the recording medium and the inserting sheet; and a determining section to compare the first printing information of the recording medium with the second printing information of the inserting sheet, so as to determine whether or not the first printing information and the second printing information are analogous to each other, based on the analogous conditions; wherein the sheet overlapping section makes the recording medium and the inserting sheet overlap with each other, when the determining section determines that the first printing information and the second printing information are analogous to each other.

(7) The image forming apparatus of item 6, wherein the sheet overlapping section comprises: a pair of rollers to sandwich the recording medium and the inserting sheet; and a controlling section to control a rotation of the pair of rollers; wherein the controlling section stops the rotation of the pair of rollers so as to match leading edges of the recording medium and the inserting sheet with each other.

(8) The image forming apparatus of item 6, wherein the analogous conditions includes at least one of a kind of sheet, a basis weight, and a size.

(9) The image forming apparatus of item 6, further comprising: a designation section to designate a page of the recording medium so as to overlap the inserting sheet and the recoding medium designated.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
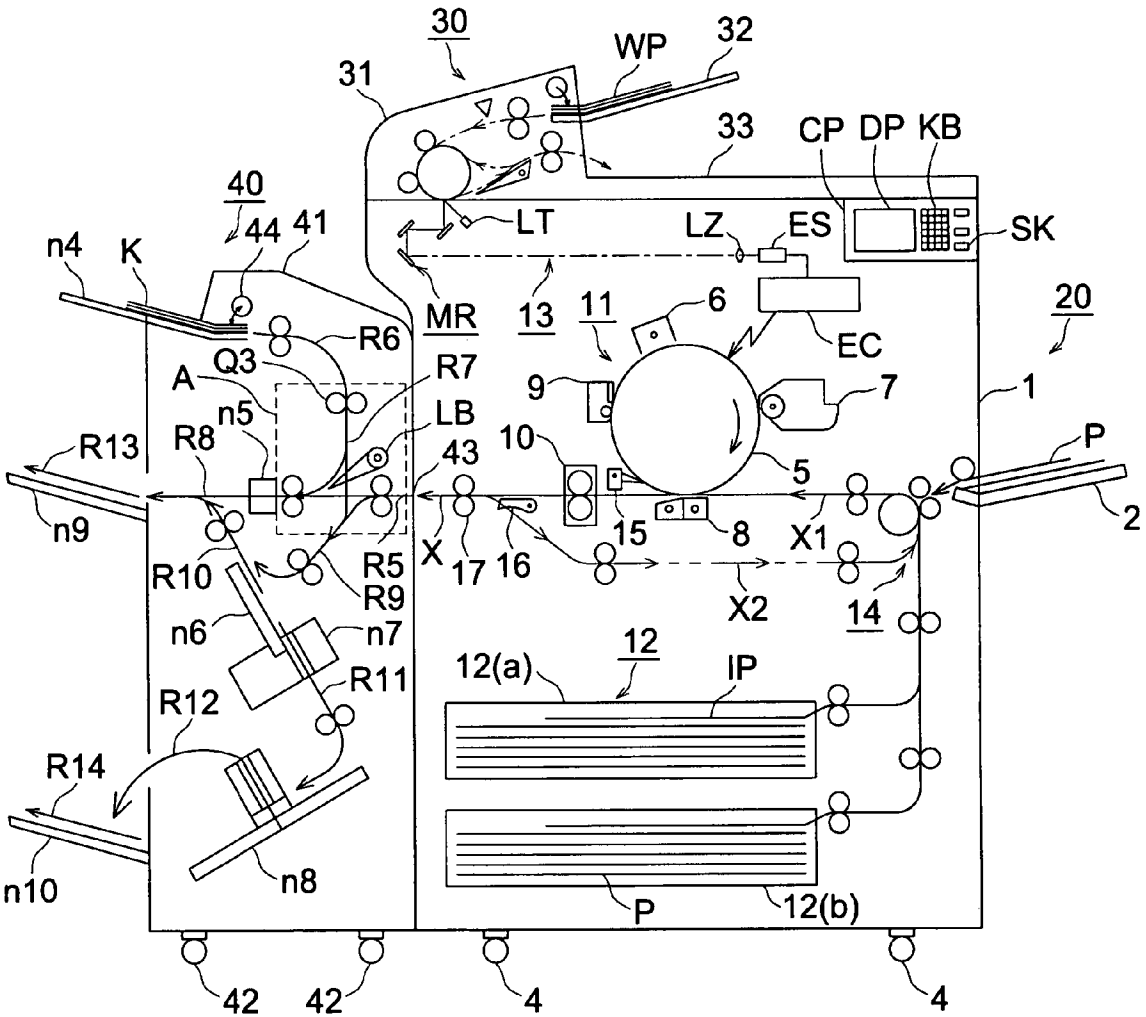
FIG. 1 shows a rough configuration of an image forming apparatus embodied in the present invention.

Referring to the drawings, the embodiment of the present invention will be detailed in the following. However, the scope of the present invention is not limited to the embodiment detailed in the following. Incidentally, the same reference number indicates the same structural element throughout the cited drawings, and the detailed explanation is conducted by referring the other drawing concerned as needed.

Figure 2:
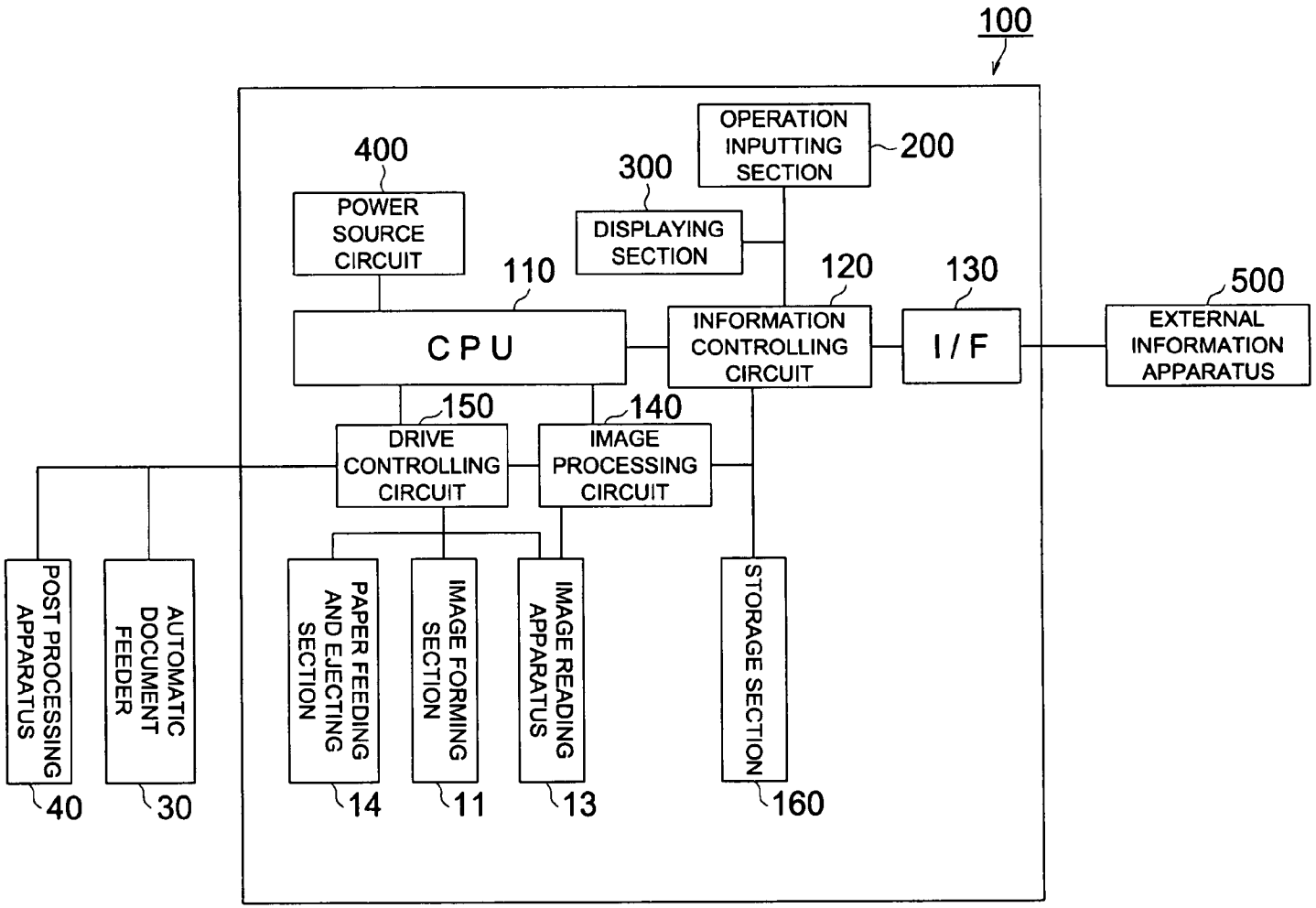
FIG. 2 shows a block diagram of a configuration of electronic circuits employed in an image forming apparatus embodied in the present invention.
Figure 3:
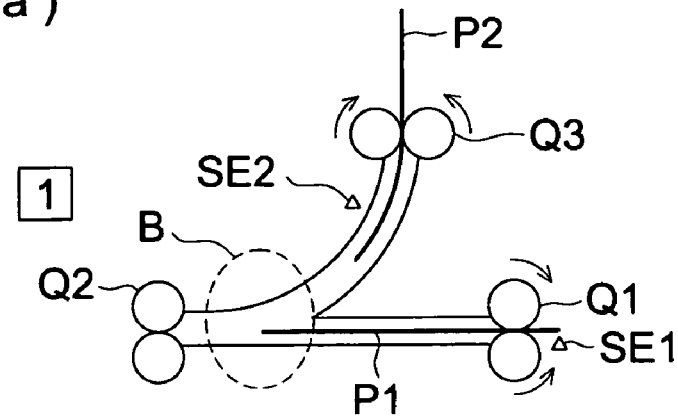
FIG. 3 shows a schematic diagram for explaining an overlapping control operation embodied in the present invention.
Figure 3:
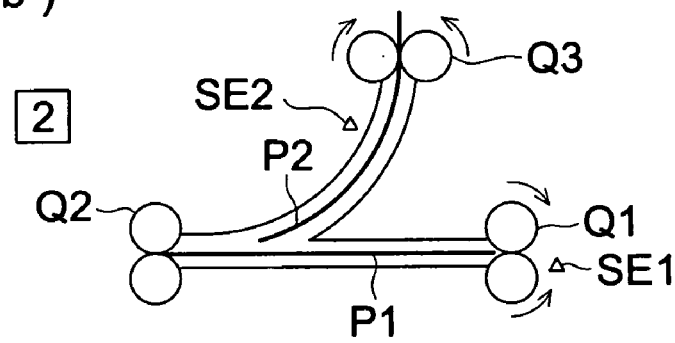
Figure 3:
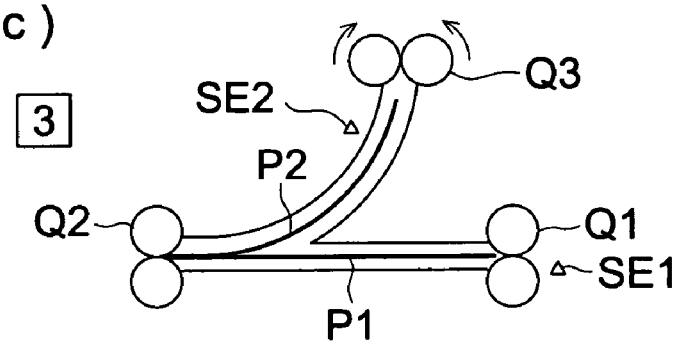
Figure 3:
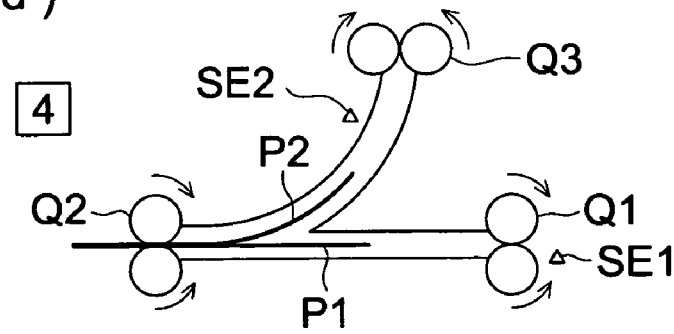
Figure 4:
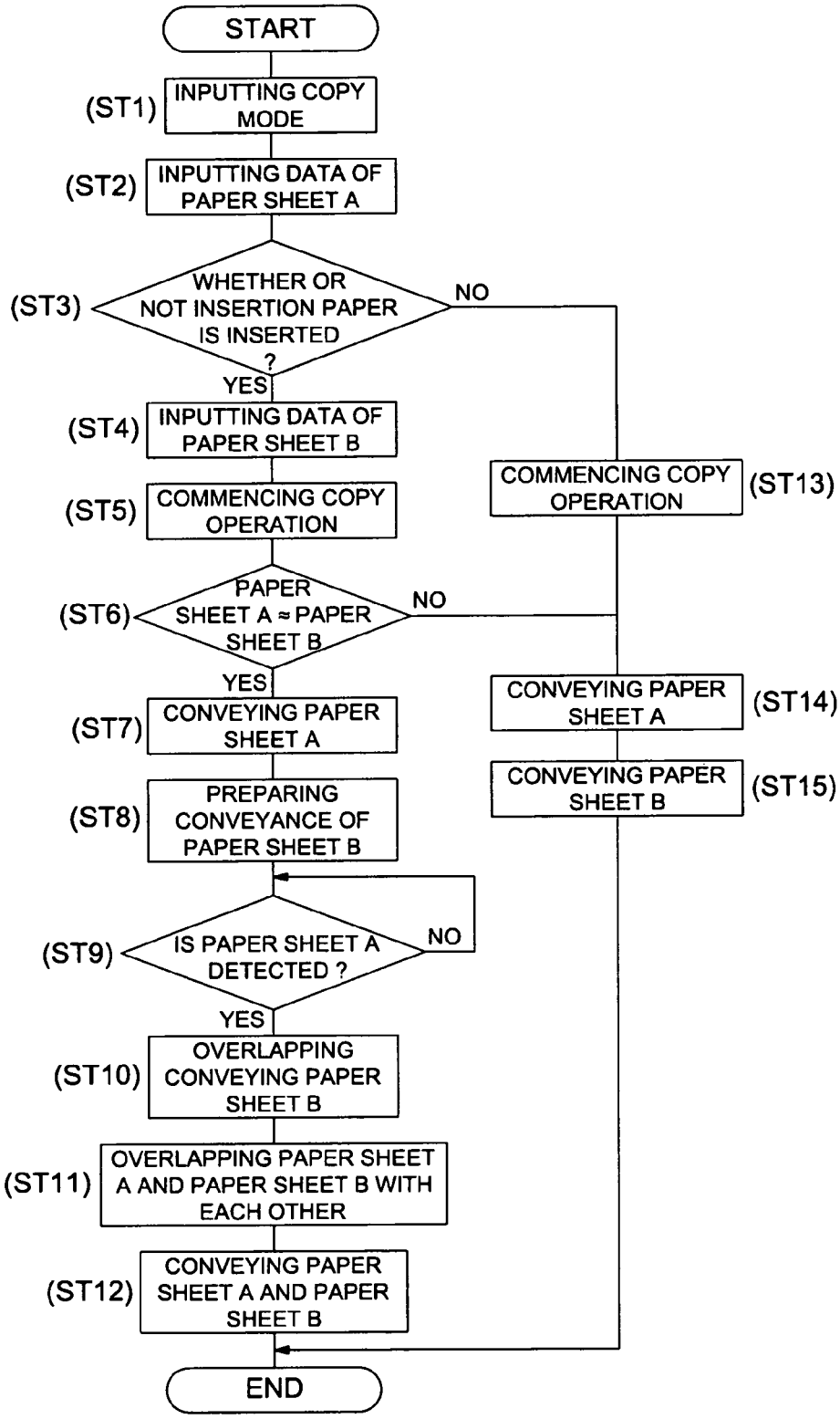
FIG. 4 shows a flowchart for explaining an overlapping control operation to be performed in an image forming apparatus embodied in the present invention.

FIG. 1 shows a rough configuration of the image forming apparatus embodied in the present invention, FIG. 2 shows a block diagram of the configuration of electronic circuits employed in the image forming apparatus embodied in the present invention, FIG. 3 shows a schematic diagram for explaining the overlapping control operation embodied in the present invention, and FIG. 4 shows a flowchart for explaining the overlapping control operation to be performed in the image forming apparatus embodied in the present invention.

Referring to FIG. 1, the configuration of image forming apparatus embodied in the present invention will be detailed in the following.

For simplicity, an image forming apparatus 20 embodied in the present invention is exemplified as a copier employing the electro-photographic method, and is couple to a post processing apparatus 40 detailed later.

Numeral 20 indicates an image forming apparatus, numeral 30 indicates an automatic document feeder (ADF), and numeral 40 indicates a post processing apparatus provided with post processing functions for applying finish processing to the transfer paper having an image recorded (also referred to as "formed") on it, such as, for instance, an insertion (addition) processing of a coversheet, a hole perforation processing, a staple processing, a fold processing, etc.

The image forming apparatus 20 is provided with a manual inserting tray 2, disposed at a right side section of a housing body 1, for feeding a relatively small number of transfer papers P. Further, the transfer papers P on which the images are already formed are ejected from the left side section of the housing body 1 so as to convey them to the post processing apparatus 40. Still further, a plurality of casters 4 are equipped to the bottom side of the housing body 1 so as to make it possible to move the image forming apparatus 20.

The transfer papers P are roughly categorized into normal transfer papers P and special transfer papers IP. The normal transfer papers P are called a standard paper or a normal paper, while a relatively thick paper (thick paper), a relatively thin paper (thin paper), an index paper having a protruded portion called a tab, an OHP sheet, a reuse paper on one side of which a certain image is already formed generally for saving the consumption of the resources, etc. can be cited as the special transfer papers IP.

Specifically, in the embodiment of the present invention, various kinds of data, such as, for instance, kinds of papers including the normal paper, the index paper, the OHP sheet and the reuse paper; sizes of papers including A4 (vertical), A4R (horizontal), B4 (vertical), B4R (horizontal), etc.; a basis weight of recording medium ($10^{-3}$ kg/m$^2$) called a normal paper, a thick paper or a thin paper; etc., can be inputted into the image forming apparatus 20 and stored in a storage section.

Incidentally, the basis weight is defined in the Japan Industrial Standard (JIS P8118), and expressed in mass per unit area (unit: $10^{-3}$ kg/m$^2$).

A control panel CP is mounted on the upper side of the housing body 1. The control panel CP is provided with an operation inputting section 200 and a displaying section 300, both of which are utilized for setting post processing conditions for activating the image forming apparatus 20 in conjunction with the automatic document feeder 30 and the post processing apparatus 40.

The control panel CP is also provided with various kinds of inputting device, such as a displaying device DP constituted by either a liquid crystal display or a touch-panel liquid crystal display in which a touch panel, etc. are incorporated, a keyboard KB, a start button (also called a copy button) SK, etc.

The displaying device DP, employing the touch panel method, is so constituted that the operator can conduct inputting operations, such as a selecting operation, a setting operation, etc., in regard to the information indicated on the displaying section by touching the displayed symbolic pattern in which a numeric character, a letter, a symbol, etc. are depicted.

Specifically, in the embodiment of the present invention, the displaying device DP, employing the touch panel method, also serves as an inputting section for inputting such an item that requires a selection of a setting option, such as an image forming mode for forming an image on the transfer papers P, a post processing condition with respect to the post processing mode for applying the post processing to the transfer papers P on which the image is already formed.

The keyboard KB, serving as an inputting device or the operation inputting section 200, is mainly used for inputting numerical values, etc., while the start button SK is used for commencing the job operation, such as the copying operation of the image forming apparatus 20, and further, the combination of the keyboard KB and the start button SK can be utilized for commencing the activation of the automatic document feeder 30 or the post processing apparatus 40. In other words, the keyboard KB and the start button SK are utilized for commencing the implementation of the consecutive image forming operations in the image forming system including the image forming apparatus 20, the automatic document feeder 30, post processing apparatus 40, etc.

The selecting and setting operations of the image forming mode as the post processing conditions, such as, for instance, whether the printed image (hereinafter, also referred to as a print or a copy) should be a colored image or a black-and-white image in respect to the transfer papers to be outputted, whether the print mode is a duplex print mode or a one side print mode, or whether or not the post processing operation should be applied, and, when applying the post processing, the selecting and setting operations of the detailed post processing conditions in regard to what kind of post processing, such as the stapling, the punching, the folding, etc., should be applied, can be conducted on the control panel CP.

Further, the selecting and inputting operations of various kinds of image forming conditions, such as, for instance, what kind of or size of the transfer paper should be employed as the transfer papers P, a number of prints or volumes to be outputted, whether expansion or reduction, setting of density, etc., can be also conducted on the control panel CP.

Specifically, in the embodiment of the present invention, based on the various kinds of post processing conditions inputted and established from the control panel CP, for instance, after the image forming operations for desired number of volumes are completed, the post processing apparatus 40 can be activated in order to apply the desired post processing operations to the transfer papers P, though details will be described later on.

Further, before implementing the image forming mode, the output status can be confirmed by activating the output confirmation mode in which the image forming operations for a number of volumes set in advance are conducted so as to obtain the desired output based on the various kinds of post processing conditions inputted and established from the control panel CP.

A controlling section EC, an image forming section 11, an image reading apparatus 13, a paper feeding and ejecting section 14, etc. are incorporated inside the housing body 1.

The controlling section EC, which is also called a controlling circuit and serves as a controlling device for controlling overall controlling operations in the image forming apparatus 20, is constituted by the electronic circuits including a CPU, etc. Further, based on the control programs and the control data stored in advance in the CPU, the controlling section EC controls and/or drives all of the sections and devices constituting the image forming apparatus 20.

Further, when the peripheral devices such as the automatic document feeder 30, the post processing apparatus 40, etc., are coupled to the image forming apparatus 20, the controlling section EC also serves as a control device for conducting the controlling and driving operations so as to smoothly operate the whole image forming system including the image forming apparatus 20 as the central apparatus of the system, as well as the above.

Still further, even when the image forming apparatus 20 is coupled to a personal computer, another information processing apparatus, etc. through the LAN (Local Area Network), etc., the controlling section EC is so constituted that the controlling section EC can conducts the controlling and driving actions including the storing and accessing actions for the information necessary for the operations concerned in conjunction with these apparatuses without generating a problem.

The image forming section 11 serves as a section for forming an image based on the image information acquired from the document image, etc. For instance, the image forming section 11 is constituted by: a photoreceptor drum 5 (also referred to as a photoreceptor member or an image bearing member) that is driven to rotate in an image creating direction established in advance (for instance, a clockwise direction indicated by the arrow shown in FIG. 1) by a driving source, such as a motor, etc.; a charging device 6 for uniformly charging the circumferential surface of the photoreceptor drum 5; an exposing device (not shown in the drawings) for irradiating an exposing light onto the photoreceptor drum 5 so as to form an electrostatic latent image on the photoreceptor drum 5 based on the image information (hereinafter, also referred to as image data); a developing device 7 for developing the electrostatic latent image formed on the photoreceptor drum 5 to a visible toner image; a transferring and separating device 8 for transferring the visible toner image formed on the photoreceptor drum 5 onto the transfer papers P, etc.; a cleaning device 9 for scraping off the residual toner or paper particles remained on the circumferential surface of the photoreceptor drum 5 after the toner image is transferred onto the transfer papers P, etc.; a fixing device for fusing and fixing the transferred toner image onto the transfer papers P; etc.

Incidentally, hereinafter, for simplicity, the image forming section 11 having a single photoreceptor drum (namely, the photoreceptor drum 5) is exemplified as an embodiment of the present invention. However, it is needless to say that the present invention can be also applied to, for instance, a tandem image forming apparatus that is provided with a plurality of photoreceptor drums corresponding to unicolor toner images of colors Y (Yellow), M (Magenta), C (Cyan), K (Black), so as to form a full color toner image on a transfer belt, serving as an intermediate transfer member, and to transfer the full color toner image onto the transfer paper at a time.

Further, in the embodiment of the present invention, some kinds of transfer papers are liable to cause a curling habit. Accordingly, when separating the transfer paper form the photoreceptor drum, sometimes depending on the kind of the transfer paper concerned, the transfer paper can hardly separate form the photoreceptor drum, resulting in an accident in which the transfer paper is wound up on the photoreceptor drum 5. To prevent such the accident, a separating nail member (separating member) 15 having a nail member that can contact and come apart from the photoreceptor drum 5 is provided as a member for helping the operation of the transfer separating section 8 for separating the transfer paper from the photoreceptor drum 5.

The image reading apparatus 13 is constituted by an optical reading system, including a light source LT, a mirror group MR, a focusing lens LZ, etc., and a reading unit ES including a CCD (Charge Coupled Device), various kinds of electronic circuits, etc.

When the image forming apparatus 20 is copier, the reading unit ES is disposed at a bottom side of the automatic document feeder 30 so as to convert the image information read from the document, which is conveyed to the reading position by the automatic document feeder 30, or put on the platen glass (not shown in the drawings) disposed at upper side of the housing body 1, to digital image data. Then, the digital image data are, for instance, compressed in order to store them into the storage section provided in the controlling section EC.

Further, when the image reading apparatus 13 reads the document conveyed by the automatic document feeder 30, the light source LT irradiates light onto the document conveyed to the reading position, and then, the light reflected from the document are guided to the focusing lens LZ through the mirror group MR so as to focus the reflected light onto the surface of the CCD equipped in the reading unit ES. The image information outputted by the CCD are stored in a storage section as image data.

The paper feeding and ejecting section 14 is constituted by a paper feeding cassette 12 and a paper feeding and ejecting conveyance section including a motor serving as a driving source, a plurality of rollers, a guiding member for regulating the conveyance direction, a lever for switching the conveyance direction, etc.

The paper feeding cassette 12 includes, for instance, a cassette 12*a* for accommodating the special transfer papers IP and a cassette 12*a* for accommodating the normal transfer papers P.

The paper feeding and ejecting conveyance section is constituted by, for instance, a straight conveyance section and a circular conveyance section. The straight conveyance section includes a straight conveyance path through which the transfer paper, conveyed from the paper feeding cassette 12 and having an image formed by the image forming section 11 on one side of the transfer papers P, can be ejected from the image forming apparatus 20.

Further, in order to form duplex images on the both obverse and reverse sides of the transfer paper, the circular conveyance section includes circular conveyance path for conveying the transfer paper in such a manner that the conveyance direction of the transfer paper, on the obverse surface of which the obverse image is already formed, is reversed in the mid-course of conveying it toward the ejecting direction so as to reverse the image forming surface and to form the reverse image onto the other side (namely, the reverse surface) of the transfer paper.

Still further, based on the print surface information (also referred to as a print mode) indicating either the duplex printing mode or the one side printing mode, inputted and set from the operation inputting section 200, the controlling section EC determines whether the straight conveyance section or the circular conveyance section should be activated, so as to control the apparatus according to the determined print mode.

When conveying the transfer paper, in response to the command signal sent from the controlling section EC, a circular conveyance controlling section activates the paper feeding and ejecting conveyance section, etc. For instance, in the one side printing mode for forming the image only on one side of the transfer paper, after the special transfer paper IP or the normal transfer paper P is selected and set in advance, either the special transfer paper IP or the normal transfer paper P selected in advance is fed and conveyed towards the photoreceptor drum 5 from the paper feeding cassette 12 at an appropriate timing by the rotating actions of the plurality of rollers rotated by activating the motor serving as a driving source, and then, after the image is formed on the one side, the transfer paper is conveyed for ejecting it outside the image forming apparatus 20.

Further, in the duplex printing mode, or the both sides printing mode (also called the both obverse and reverse sides printing mode), for forming the images on the both sides of the transfer paper, in response to the command signal sent from the controlling section EC, the circular conveyance controlling section activates the paper feeding and ejecting conveyance section, etc., so that the rotating action of a reversing roller 17 is deactivated in the mid-course of conveying the transfer paper, on which the image is already formed by the image forming section 11, toward the ejecting direction (indicated by the arrow X shown in FIG. 1), for instance, at the time when the leading edge of the transfer paper passes through the reversing roller 17, and successively, the rotating direction of the reversing roller 17 is switched to such a direction that the transfer paper is returned to the image forming section 11.

At the same time, by activating a reversing member 16 so as to rotate in a clockwise direction, the progressing direction of the transfer paper conveyed towards the image forming section 11 is changed to the direction of the path indicated by the arrow X2 (also called the circular conveyance path).

Then, after the transfer paper is temporarily made to be in a standby state by conveying the transfer paper in the circular path based on the circular possible number of paper sheets, the transfer paper is conveyed from the direction indicated by the arrow X2 to the direction indicated by the arrow X1 at an appropriate timing, so that the image forming section 11 again conducts the image forming operation, and then, the transfer paper, on both sides of which the obverse and reverse images are formed, is ejected in the direction indicated by the arrow X in order to convey it to the post processing apparatus 40.

Incidentally, generally speaking, in almost of all image forming apparatus, certain guiding members are equipped in the conveyance path of the transfer paper so as to appropriately conveying the transfer paper. However, in the embodiment of the present invention, the explanations and drawings for such the guiding members are omitted, in order to simplify the descriptions as a whole.

The automatic document feeder will be briefly described in the following.

In the automatic document feeder 30, the conveyance mechanism is covered by a housing case 31, while a document stacking tray 32 and a document ejecting section 33 are disposed outside the housing case 31.

A plurality of documents WP are putted on the document stacking tray 32, for instance, in such a manner that the first page of the plurality of documents WP is located at uppermost position in a face up state (namely, an information recorded side up state). The plurality of documents WP putted on the document stacking tray 32 are conveyed one by one to the reading position by the document conveying mechanism, constituted by a plurality of rollers, etc. At the reading position, the reading unit ES reads the image information residing on each of the documents WP, and then, each of documents WP is successively ejected onto the document ejecting section 33.

The automatic document feeder 30 is operated in conjunction with the controlling section EC of the image forming apparatus 20 by a drive controlling circuit (not shown in the drawings).

The post processing apparatus 40 will be briefly described in the following.

A processor housing case 41 mechanically covers the post processing apparatus 40 as a whole. An insertion inlet 43 for accepting the transfer paper on which the image is already formed and which is ejected from the image forming apparatus 20 is disposed at a right side section of the processor housing case 41 (facing to the image forming apparatus 20), while a coversheet feeding section n4 for stacking coversheets K to be fed, for instance, a first ejecting tray n9 (serving as a stacking section) on which a bundle of the transfer papers stapled is to be stacked, and a second ejecting tray n10 for accepting a bundle of the transfer papers folded are disposed at a left side section of the processor housing case 41. Further, a plurality of caster rollers 42 mounted on the bottom side of the processor housing case 41 allow the post processing apparatus 40 to be moved by the operator.

The drive controlling circuits and the driving source, including a motor, etc., are incorporated in the processor housing case 41 so that these can be operated in conjunction with the controlling section EC of the image forming apparatus 20. A shift processing and punching section n5 (hereinafter, also referred to as a perforation device), an intermediate stacker n6 (hereinafter, also referred to as a stacking section), a stapler n7 (hereinafter, also referred to as a stapling section) and a folding device n8 are also incorporated in the processor housing case 41. In addition, conveyance paths R5, R6, R7, R8, R9, R10, R11, R12, R13 and R14 are provided in the processor housing case 41.

The conveyance paths R5 - R11 are mainly formed by the post processing conveyance mechanisms constituted by a plurality of conveyance rollers including driving rollers and driven rollers. For instance, a pickup roller 44 for picking up each of the coversheets K one by one, a pre-feeding stop position Q3, including conveyance rollers for temporarily stopping the conveying action of the coversheet K so as to put it in a standby state, are provided along the conveyance path R6.

Specifically, in the embodiment of the present invention, when a recording medium, such as the coversheet K, etc., on which the image is not to be formed (namely, the insertion recording medium), is overlapped with the transfer paper (the recording medium) ejected from the image forming apparatus 20, there is provided a recording medium overlapping section (indicated by the broken lines shown in FIG. 1 and detailed later) that makes it possible to overlap the insertion recording medium on the transfer paper while aligning the leading edges of them each other, and to convey them at the same time in the overlapped state.

Incidentally, although FIG. 1 indicates an example of the position at which the recording medium overlapping section is to be disposed, the scope of the present invention is not limited to the embodiment shown in FIG. 1. It is desirable that the recording medium overlapping section is disposed at such a position that makes it possible to easily conduct the overlapping operation, corresponding to the functional efficiencies, structural configurations, etc. of both the image forming apparatus and post the processing apparatus.

Further, a conveyance path changing section including a rotatable guide member LB for changing the conveyance path from the conveyance path R5 to the conveyance path R8 or the conveyance path R8, or from the conveyance path R7 to the conveyance path R8 or the conveyance path R8.

Still further, generally speaking, the coversheet K, to be employed as a coversheet, etc., is made of a sheet of paper, a resin film, etc. However, sometimes, a sheet of special material or a specially-finished sheet, for instance, such as a wooden material, a leather material, a metal foil, etc., is employed for the coversheet K.

Now, the operations of the post processing apparatus 40 will be briefly described in the following.

Incidentally, in order to simplify the explanation, it is assumed that the coversheet K is inserted as a coversheet, and it is established in advance that the coversheet K is inserted as a coversheet. Further, it is also assumed that this premise condition is established in advance by inputting it from the operation inputting section 200 of the image forming apparatus 20.

When inserting the coversheets K, the post processing conveyance mechanisms are activated by the drive controlling circuits of the post processing apparatus 40 operated in conjunction with the image forming apparatus 20. Then, the pickup roller 44 picks up each of the coversheets K stacked on the coversheet feeding section n4 one by one to convey it along the conveyance path R6. Successively, at the time when the coversheet K is batted against the pre-feeding stop position Q3, the coversheet K stops while its leading edge contacts the pre-feeding stop position Q3.

In the embodiment of the present invention, the recording medium overlapping section (indicated by the frame of the broken lines shown in FIG. 1 and detailed later) makes it possible to overlap the coversheet K on the transfer paper on which the image is already formed, while aligning the leading edges of them each other, and to convey them at the same time in the overlapped state.

Based on the information sent from the image forming apparatus 20, synchronized with the timing when the transfer paper, on which the image is already formed, is ejected from the image forming apparatus 20, the post processing conveyance mechanisms are reactivated in order to re-convey the coversheet K temporarily stopped at pre-feeding stop position Q3 as the standby state, and accordingly, the coversheet K progresses along the conveyance path R7.

When the stapling operation, the punching operation and the folding operation are not applied to the transfer paper, the rotatable guide member LB is stopped at the position indicated in FIG. 1. Accordingly, the coversheet K is conveyed from the conveyance path R7 to the conveyance path R8 and further conveyed to the conveyance path R13 so as to be ejected onto the first ejecting tray n9. Successively, the transfer paper, on which the image is already formed, enters into the conveyance path R5 from the insertion inlet 43, and is further conveyed from conveyance path R8 to the conveyance path R13 so as to be ejected onto the first ejecting tray n9. As a result, the bundle of the transfer papers with the coversheet is created.

When the stapling operation, the punching operation and/or the folding operation are/is applied to the transfer paper, the rotatable guide member LB is stopped at a position rotated in an anticlockwise direction from the position indicated in FIG. 1. Accordingly, the coversheet K is fed from the pre-feeding stop position Q3 and further conveyed from the conveyance path R7 along the conveyance path R9 so as to be ejected onto the intermediate stacker n6.

As the same manner, when the transfer paper, on which the image is already formed, enters into the conveyance path R5 from the insertion inlet 43, since the rotatable guide member LB is stopped at the position rotated in the anticlockwise direction from the position indicated in FIG. 1, the transfer paper cannot enter the conveyance path R8, but enters into the conveyance path R9 by changing its conveying path. Then, the transfer paper is conveyed along the conveyance path R9 so as to be ejected onto the intermediate stacker n6. At this time, in the intermediate stacker n6, the coversheet K previously ejected and the transfer papers successively ejected later are trued so as to create the bundle of the transfer papers with the coversheet.

When the stapling operation is applied to the transfer paper, the bundle of the coversheet K and the transfer papers is stapled at a time by the stapler n7, and conveyed from the conveyance path R10 to the conveyance path R13 so as to be ejected onto the first ejecting tray n9. As a result, the bundle of the transfer papers stapled with the coversheet is created.

When the stapling operation, the punching operation and the folding operation are applied to the transfer paper, the bundle of the coversheet K and the transfer papers is stapled at a time by the stapler n7, and punched by the shift processing and punching section n5 to perforate it, and further conveyed along the conveyance path R11. Then, the bundle of the coversheet K and the transfer papers is folded by the folding device n8, and conveyed from the conveyance path R12 to the conveyance path R14 so as to be ejected onto the second ejecting tray n10. As a result, the bundle of the transfer papers stapled, punched and folded with the coversheet is created.

When implementing a sort processing, the coversheet K is temporarily stopped at the shift processing and punching section n5 disposed at a halfway position of the conveyance path R8, and then, the successive transfer papers are stacked at this halfway position. After that, the bundle of the coversheet K and the transfer papers can be move in either an upper or a lower direction parallel to the sheet surface and perpendicular to the conveyance direction. Further, since a plurality of first ejecting trays n9 are arranged as multi-stages, the bundle of the coversheet K and the transfer papers can be conveyed to any one of the plurality of first ejecting trays n9 by the cooperating actions of the shift processing and punching section n5 and the first ejecting tray n9.

When only the folding operation is applied to the transfer paper, the bundle of the coversheet K and the transfer papers, ejected onto the intermediate stacker n6 and stacked on the intermediate stacker n6, is trued at the intermediate stacker n6, and then, conveyed to the folding device n8 along the conveyance path R11 so as to be folded by the folding device n8, and the folded bundle is conveyed from the conveyance path R11 along the conveyance path R14 so as to be ejected onto the second ejecting tray n10. It is also applicable that the folded bundle is ejected from the folding device n8 to the first ejecting tray n9.

Next, referring to the FIG. 2, the circuit configuration of the image forming apparatus embodied in the present invention will be detailed in the following.

Numeral 100 indicates a configuration of the image forming apparatus including various kinds of sections and circuits, while numeral 110 indicates a CPU (Central Processing Unit) for controlling the image forming apparatus as a whole, in which programs for controlling the image forming apparatus 20 in various kinds of controlling modes, data necessary for implementing the programs, etc. are stored in advance.

An information controlling circuit 120, an image processing circuit 140, a drive controlling circuit 150, a power source circuit 400, etc. are coupled to the CPU 110. Further, the abovementioned circuits and the CPU 110 constitutes the controlling section EC shown in FIG. 1, so that the controlling section EC can control the image forming system including the image forming apparatus 20 as the central apparatus as a whole while cooperating with the automatic document feeder 30 and the post processing apparatus 40, which will be detailed later.

In response to command signals sent from the CPU 110, the information controlling circuit 120 is coupled to an external information apparatus 500 through an interface (I/F) 130 in order to input image information, such as character data, image data, etc., and setting information necessary for image forming operations, etc., such as density information, magnification information, etc., as job information in a unit of one job, serving as one print job unit, and to store them into a storage section 160.

Further, other than the job information inputted from the external information apparatus 500, the information controlling circuit 120 automatically, appropriately and smoothly transmits meta data associated with the job information (hereinafter, also referred to as job data), for instance, such as instruction information with respect to the detailed controlling operations for activating the various kinds of circuits and sections including the image processing circuit 140 and the drive controlling circuit 150, various kinds of information in regard to a kind of transfer paper, an image forming mode, etc. inputted from the operation inputting section 200, etc., to each of the circuits and each of the sections in the image forming apparatus without disturbing the image forming operations currently implemented.

Still further, the information controlling circuit 120 judges various kinds of information outputted from sensors, etc. equipped in the various kinds of circuits and section, in order to support the CPU 110 so that the CPU 110 can send appropriate command signals to them.

Mainly, a computer and an Internet server could be cited as the external information apparatus 500. Depending on the situation, however, another image forming apparatus coupled to a LAN (Local Area Network) or an information apparatus, such as a digital camera, a measuring instrument capable of outputting measured information, etc., could be also regarded as the external information apparatus 500.

Incidentally, the information controlling circuit 120 determines whether or not the post processing mode for applying the post processing is selected by operation inputting section 200. When determining that the post processing mode is selected, the information controlling circuit 120 notifies the CPU 110 of this decision. Then, the CPU 110 executes the program established in advance for activating the post processing apparatus 40 through the drive controlling circuit 150 so as to conduct the operations corresponding to the post processing mode selected in the above.

The interface (I/F) 130 serves as a information transmitting and accepting section and can be coupled to the external information apparatus 500, such as the computer, the other image forming apparatus, the Internet server, etc. mentioned in the above, through the various kinds of networks.

The operation inputting section 200 is constituted by the inputting devices including various kinds of button devices, such as the keyboard KB mounted on the control panel CP of the image forming apparatus 20, the start button SK, etc., the liquid crystal displaying device DP employing the touch panel method and also serves as a displaying device, etc.

For instance, when the start button SK is pushed, the conveyance operation of the document stacked on the automatic document feeder 30 is commenced; namely, the image forming apparatus 20 commences the copy operation. At the same time; if the post processing mode is established, the cooperated actions between the image forming apparatus 20 and the post processing apparatus 40 conduct the post processing mode.

Further, by operating the keyboard KB, the setting information, such as a kind or a number of transfer papers to be outputted (for instance, an index paper sheet, a thick paper sheet, a thin paper sheet, a recycle paper sheet, an OHP sheet, a reuse paper sheet, etc.), a magnification value for expansion or reduction processing, density of an output image, etc., can be inputted, while, by using the liquid crystal displaying device DP, any one of various kinds of operating mode of the image forming apparatus 20 can be set.

With respect to the image forming mode, four modes, for instance, including 1) one side print mode outputted from one side printed document, 2) duplex print mode outputted from one side printed documents, 3) one side print mode outputted from both sides printed document, 4) duplex print mode outputted from both sides printed document, are provided and displayed on the liquid crystal displaying device DP respectively on the buttons, so as to make it possible for the operator to select any one of the four modes.

Specifically, in the embodiment of the present invention, it is possible to set the post processing conditions in regard to the post processing apparatus 40 by employing the liquid crystal displaying device DP equipped with the touch panel, capable of both the displaying and the inputting operations. For instance, it is possible to set the post processing mode, such as the staple processing, the punch processing, the fold processing, the sort processing, etc., or a number of pages indicating the inserting position in the insertion mode in which the coversheet, serving as an insertion recording medium, is to be inserted. In addition, it is also possible to set various kinds of conditions as the coversheet or the sheet inserting conditions, such as an obverse coversheet, a reverse coversheet or an integrated coversheet employed for both obverse and reverse sides by folding it, or a kind of paper sheet to be inserted into intermediate section of a booklet as a divider of items or contents, etc.

In response to the command signals sent from the CPU 110, the image processing circuit 140 converts the image information of the document read by the image reading apparatus 13 to digital image data, and compresses the digital image data so as to store them into the storage section 160. Further, when the image forming section 11 conducts the image forming operation, the image processing circuit 140 expands the compressed digital image data stored in the storage section 160 and coverts the expanded digital image data to the processed data or signals, etc. appropriate for the image forming method employed in the image forming section 11.

In response to the command signals sent from the CPU 110 and based on the operating mode established in advance, the drive controlling circuit 150 drives the image forming section 11, the image reading apparatus 13, the paper feeding and ejecting section 14, the automatic document feeder 30, the post processing apparatus 40, etc., at appropriate timings, so as to conduct the image forming operations.

Further, the storage section 160 can store the image data necessary for forming the image, the job information and the job data including setting conditions for controlling the image forming apparatus 20 and the information, such as the programs for the various kinds of setting modes to be conducted by the image forming apparatus 20, etc., in it.

Still further, in the embodiment of the present invention, the recording medium data, including kinds, basis weights, sizes of transfer papers serving as the recording mediums, coversheets K serving as the insertion recording mediums, etc., can be stored, respectively.

Still further, for instance, when any one of the recording medium data of kinds, basis weights, sizes for the recording mediums established in advance or analogous conditions combined with these data, the insertion mode for inserting the insertion recording mediums, etc. are established form the control panel CP, the information controlling circuit 120 respectively reads out the recording medium data for both the recording mediums and the insertion recording mediums in order to compare them with each other.

As a result of comparing the respective recording medium data of the recording mediums and the insertion recording mediums, when the information controlling circuit 120 determines that the recording medium data correspond to the analogous conditions, the drive controlling circuit 150, etc. are activated so as to overlap the recording mediums and the insertion recording medium with each other and to convey them. On the contrary, when determining that the recording medium data do not correspond to the analogous conditions, the drive controlling circuit 150, etc. are activated so as to convey the recording mediums and the insertion recording medium independently relative to each other.

Incidentally, when setting the analogous conditions in the embodiment of the present invention, it is premised that a conveyance defect, such as a jam, etc., does not occur even if the transfer papers are conveyed in the overlapping state. For instance, as far as the sizes of the recording mediums are the same even if the basis weights of them are different from each other to some extent, it is possible to set a basis weight within a certain range as the analogous condition so as to make it possible to overlap them with each other.

In the embodiment of the present invention, hereinafter, the job information and the job data are defined as follow.

When the image forming apparatus 20 is a copier, for instance, the job information has a meaning as information of individual job, such as a setting operation of the document, a selection of either one side or duplex mode, a selection of paper feeding cassette, a selection of number of copies, a selection of printing density, etc., which are based on the image information of the document, and is defined as consecutive image data determined by conducting the output setting and commencing the copy operation. Further, a print data group corresponding to such the one print instruction (hereinafter, also referred to as one print unit) is defined as "1 JOB".

Further, as well as the above, for instance, when the image forming apparatus 20 is a printer, the consecutive image data group transmitted from the external information apparatus is defined as the job information, and the print data group corresponding to one print instruction is defined as "1 JOB". Further, to handle the job information and the job data for every "1 JOB" is defined as "1 JOB unit".

Incidentally, the job data is defined as meta data associated with the job information and serving as data of control values with respect to the operation for setting the conveyance velocity corresponding to a kind of the transfer paper or the controlling items for implementing the image forming operation.

Accordingly, the job information and the job data are stored in the storage section 160 in a unit of "1 JOB", namely, for every "1 JOB unit".

As shown in FIG. 1, the image forming section 11 is constituted by the photoreceptor drum 5, a charging section 6, a developing section 7, the transfer separating section 8, a fixing section 10, the separating nail member 15, etc., and driven by the drive controlling circuit 150.

Accordingly, the image forming section 11 is controlled on the basis of the image data, the job information and the job data, read from the document by the image reading apparatus 13 and stored in the storage section 160, so as to form the toner image on the photoreceptor drum 5 and to transfer the toner image onto the transfer papers P or the special transfer papers IP.

As shown in FIG. 1, the image reading apparatus 13 is constituted by the optical reading system and the reading unit ES. The image reading apparatus 13 is activated by the drive controlling circuit 150, so as to read the image information of the document conveyed to the reading position by employing the reading unit ES. Then, the image information read by the reading unit ES are converted to, for instance, the digital image data, and then, the digital image data are compressed and stored in the storage section 160.

As mentioned in the above, the paper feeding and ejecting section 14 is constituted by the paper feeding cassette 12, the paper feeding and ejecting conveyance section, the circular conveyance controlling section and a circular-possible number of sheets setting section.

As shown in FIG. 1, the automatic document feeder 30 is such an apparatus that automatically picks up each of the document sheets stacked on the document stacking tray 32 one by one and conveys it to the reading position, and is operated in conjunction with the drive controlling circuit 150, in response to the command signals sent from the CPU 110 of the image forming apparatus 20.

In response to the command signals sent from the CPU 110, the post processing apparatus 40 cooperates with the drive controlling circuit 150 to activate the post processing conveyance mechanisms through the drive controlling circuit of the post processing apparatus 40, so as to implement the post processing mode, such as the operation for inserting the coversheet, the staple processing, the fold processing, the sort processing, etc., based on the program established in advance, the post processing conditions set by the operation inputting section 200, etc.

When the operator turns ON a power switch (not shown in the drawings), the power source circuit 400 appropriately supplies the electric currents to various sections and devices of the image forming apparatus as a whole. When the operator turns OFF a power switch, the power source circuit 400 cuts off the supply of the electric currents.

Incidentally, even if the power switch is turned ON, for instance, in the power saving mode for putting the image forming apparatus in a standby state, the power source circuit 400 continues to supply only a small amount of electric current necessary for holding the memorized contents stored in the volatile memory, while cuts off the other electric currents necessary for the heater of the fixing section, etc.

Now, referring to FIGS. 3(*a*)-3(*d*), the configuration of the recording medium overlapping section will be detailed in the following.

Numerals Q1, Q2, Q3 indicate pairs of conveyance rollers, constituting the recording medium overlapping section, which are driven to rotate and stop by a driving source (not shown in the drawings), in response to the command signals sent from the controlling section EC. The pair of conveyance rollers Q1 is activated so as to convey the recording medium P1, such as the transfer paper, etc., on which the image is already formed and conveyed from the image forming apparatus 20, into the post processing apparatus 40. While, the pair of conveyance rollers Q3 also serves as the pre-feeding stop position Q3 as aforementioned. Concretely speaking, the pair of conveyance rollers Q3 temporarily stops an insertion recording medium P2, such as the coversheet K, etc., picked up from the coversheet feeding section n4, and waits in the standby state until the controlling section EC outputs the command signal for resuming the conveyance operation. Then, the recording medium P1 conveyed by the pair of conveyance rollers Q1 and the insertion recording medium P2 conveyed by the pair of conveyance rollers Q3 overlap with each other at the merging point (indicated by the broken circular line shown in FIG. 3(*a*)) while the both leading edge portions of them are aligned with each other, and then, the pair of conveyance rollers Q2 is activated so as to convey them at a time in the overlapped state.

Numeral SE1 indicates a leading edge detecting sensor for detecting the leading edge of the recording medium P1 in the conveyance direction, while numeral SE2 indicates a leading edge detecting sensor for detecting the leading edge of the insertion recording medium P2 in the conveyance direction.

Next, the operations of the recording medium overlapping section will be detailed in the following. Numbers 1 - 4 surrounded by the frame indicates the order of the operations, corresponding to FIG. 3(*a*)-FIG. 3(*d*) shown in the following.

At first, it is assumed as a premise that the overlapped conveyance mode for conveying the recording medium P1 and the insertion recording medium P2 in the overlapping state is selected, and the recording medium P1 and the insertion recording medium P2 corresponds to the analogous conditions (shown in FIG. 3(*a*)).

In response to the command signal sent from the CPU 110 of the controlling section EC, the drive controlling circuit 150 rotates the pair of conveyance rollers Q3, serving as a insertion recording-medium conveyance section, in the direction indicated by the arrow shown in FIG. 3(*a*), so as to commence the action for conveying the insertion recording medium P2. When a leading edge detecting sensor SE2 detects the leading edge portion of the insertion recording medium P2, the information controlling circuit 120 stops the rotating action of the pair of conveyance rollers Q3 through the drive controlling circuit 150, so as to temporarily stop the conveying action of the insertion recording medium P2.

On the other hand, in response to the command signal sent from the CPU 110, the drive controlling circuit 150 also rotates the pair of conveyance rollers Q1, so as to convey the recording medium P1 conveyed from the image forming apparatus 20 into the post processing apparatus 40.

When a leading edge detecting sensor SE1 detects the leading edge portion of the recording medium P1, the leading edge detecting sensor SE1 outputs a leading edge detecting signal to the information controlling circuit 120. Based on the leading edge detecting signal detected by the leading edge detecting sensor SE1, the information controlling circuit 120 instructs the drive controlling circuit 150 to resume the rotating action of the pair of conveyance rollers Q3. Further, the information controlling circuit 120 controls the drive controlling circuit 150 so as to conduct the time controlling operation, for instance, in which the. pair of conveyance rollers Q1 is made to be stopped at the time when a predetermined time has elapsed since the leading edge detecting sensor SE1 detected the leading edge portion of the recording medium P1 (shown in FIG. 3(*b*)).

When the leading edge portion of the recording medium P1 currently conveyed by the pair of conveyance rollers Q1 is batted against the pair of conveyance rollers Q2, the rotating action of the pair of conveyance rollers Q1 is made to be stopped. While, by resuming the rotating action of the pair of conveyance rollers Q3, the insertion recording medium P2 is conveyed towards the pair of conveyance rollers Q2 (shown in FIG. 3(*c*)).

Further, since the information controlling circuit 120 controls the drive controlling circuit 150 so as to conduct the time controlling operation equivalent to that for the pair of conveyance rollers Q1, when the leading edge portion of the insertion recording medium P2 currently conveyed by the pair of conveyance rollers Q3 is batted against the pair of conveyance rollers Q2, the rotating action of the pair of conveyance rollers Q3 is made to be stopped.

Accordingly, by butting both the leading edge portion of the recording medium P1 conveyed previously and the leading edge portion of the insertion recording medium P2 conveyed later against the pair of conveyance rollers Q2, the overlapping operation for overlapping the recording medium P1 and the insertion recording medium P2 with each other while aligning the both leading edge portions of them to each other is achieved (shown in FIG. 3(*d*)).

When the overlapping operation is completed, both the recording medium P1 and the insertion recording medium P2 are conveyed at the same time in the overlapped state.

Concretely speaking, assuming that the both leading edge portions of the recording medium P1 and the insertion recording medium P2 were already batted against the pair of conveyance rollers Q2, the rotating action of which was deactivated, and already overlapped with each other, at the time when the predetermined time has elapsed since the rotating action of the pair of conveyance rollers Q3 was resumed so as to resume the conveyance operation of the insertion recording medium P2, the information controlling circuit 120 controls the drive controlling circuit 150 so as to commence the rotating action of the pair of conveyance rollers Q2 after the predetermined time has elapsed. Therefore, both the recording medium PI and the insertion recording medium P2 can be conveyed at the same time in the overlapped state.

Incidentally, in the case that the next recording medium PI is successively introduced into the post processing apparatus 40 in the abovementioned situation, the rotating action of the pair of conveyance rollers Q1 is commenced and the processing steps 1 - 4 shown in FIGS. 3(*a*)-3(*d*) are repeated.

Further, although, in the embodiment of the present invention, the aforementioned time controlling operation is exemplified as an example of a rotation control of the pairs of conveyance rollers Q1, Q2, Q3, the scope of the rotation control embodied in the present invention is not limited to such the time controlling operation.

Still further, when the insertion recording medium P2, for instance, does not corresponds to the analogous conditions with respect to the recording medium P1, the recording medium P1 and the insertion recording medium P2 are respectively and independently conveyed in an order established in advance. However, it is applicable that both of them virtually overlap with each other at the time when the post processing, such as the staple processing, etc., is conducted.

Next, referring to the flowchart shown in FIG. 4, the processing steps of the overlapping operation will be detailed in the following.

The purpose of the overlapping operation embodied in the present invention is to shorten the conveyance time and to improve the productivity of the image forming apparatus by conveying the recording medium and the insertion recording medium in the overlapped state.

Specifically, when making the recording medium and the insertion recording medium overlap with each other, both of them are conveyed in the overlapped state if the recording medium data of the recording medium are analogous to that of the insertion recording medium, while the recording medium and the insertion recording medium are respectively and independently conveyed if the recording medium data of the recording medium are not analogous to that of the insertion recording medium. Accordingly, it becomes possible to prevent the recording mediums from jamming, etc. caused by the difference of the recording medium data between them, resulting in an improvement of the productivity of the image forming apparatus.

It is assumed as a premise that the image forming apparatus is a copier, and the copier is coupled to the post processing apparatus. Incidentally, hereinafter, the recording medium, on which the image is to be formed on the basis of the image information, is defined as a paper sheet A, while the insertion recording medium, such as the coversheets K, etc., is defined as a paper sheet B.

In Step ST1, a copy mode is inputted. The various kinds of outputting conditions with respect to the output mode of the copied recording medium are set from the control panel CP. Specifically, in the embodiment of the present invention, the result of determining whether or not the insertion recording medium, such as the coversheets K, etc., should be inserted is inputted and set according to inputting procedures established in advance.

In the embodiment of the present invention, the insertion mode for inserting the insertion recording medium is provided. Accordingly, the insertion mode is established herewith in order to proceed to the next step of Step ST2.

Incidentally, in the embodiment of the present invention, the information controlling circuit 120 smoothly transmits the information, indicating that the insertion mode is established from the control panel CP, to the sections concerned.

In Step ST2, the data of paper sheet A are inputted. Concretely speaking, when the recording medium data of the paper sheet A, such as, for instance as aforementioned, a kind of recording medium, a basis weight, a size, etc., are inputted from the control panel CP, the information controlling circuit 120 stores the recording medium data with respect to the paper sheet A established into the storage section 160, in order to proceed to the next step of Step ST3.

Incidentally, it is applicable that the recording medium data with respect to the frequently used recording medium are stored in advance in the storage section 160, while, only with respect to the recording medium whose data are not stored in advance, the recording medium data are inputted.

In Step ST3, it is determined whether or not the insertion paper should be inserted. In the present embodiment, since the insertion mode is established herewith, the information controlling circuit 120 transmits the information to the CPU 110, etc., so as to commence the execution of the controlling programs based on the insertion mode, to proceed to the next step of Step ST4.

Incidentally, when the insertion mode is not established, the process will proceed to Step ST13.

In Step ST4, the data of paper sheet B are inputted. Concretely speaking, as in the similar manner for inputting the recording medium data of the paper sheet A, when the data, such as, for instance as aforementioned, a kind of recording medium, a basis weight, a size, etc., are inputted from the control panel CP, the information controlling circuit 120 stores the recording medium data with respect to the paper sheet B established into the storage section 160, in order to proceed to the next step of Step ST5.

In Step ST5, the copy operation is commenced. The recording medium data of the paper sheet A and the paper sheet B are inputted, and, under the instructions outputted from the CPU 110, the image forming apparatus 20 activates the image processing circuit 140 and the drive controlling circuit 150 so as to commence the operations for forming image based on the image information on the paper sheet A, to proceed to the next step of Step ST6.

In Step ST5, it is determined whether or not the recording medium data of the paper sheet A and the paper sheet B correspond to the analogous conditions established in advance. The operator can establish the analogous conditions as the individual data or the combination of the data, such as, for instance, kinds of papers including the normal paper, the index paper, the OHP sheet and the reuse paper; sizes of papers including A4 (vertical), A4R (horizontal), B4 (vertical), B4R (horizontal), etc.; a basis weight of recording medium ($10^{-3}$ kg/m$^2$) called a normal paper, a thick paper or a thin paper; etc., as needed.

For instance, when it is established that the basis weights of recording mediums, also called a normal paper, a thick paper or a thin paper, are analogous and the size is A4 (vertical), it is established that, with respect to the kind, the basis weight and the size of the recording medium, the paper sheet A is the A4 sized standard paper having a normal thickness and, while the paper sheet B, serving as an insertion recording medium, is the A4 sized normal paper being a thick paper.

The information controlling circuit 120 reads out the recording medium data of both the paper sheet A and the paper sheet B from the storage section 160 to compare them with each other based on the analogous conditions. At this time, although the basis weight of the paper sheet A, having a normal thickness, is different from that of the paper sheet B being a thick paper, it is determined that the recording medium data of the paper sheet A and the paper sheet B correspond to the analogous conditions since the basis weight is established in advance as the analogous condition, and then, the process proceeds to the next step of Step ST7.

Incidentally, when it is determined that the recording medium data of the paper sheet A and the paper sheet B do not correspond to the analogous conditions, the process proceeds to Step ST14.

In Step ST7, the paper sheet A is conveyed. The paper sheet A on which the image is already formed is conveyed to the post processing apparatus, in order to proceed to the next step of Step ST8.

In Step ST8, the conveyance operation of the paper sheet B is prepared. In order to make the paper sheet A and the paper sheet B overlap with each other by employing the overlapping section, as aforementioned referring to FIG. 3(*a*), the paper sheet B is conveyed and temporarily stopped at a position just before the merging point (indicated by the broken circular line shown in FIG. 3(*a*)), and then, the process proceeds to the next step of Step ST9.

In Step ST9, the paper sheet A is detected. As aforementioned referring to FIG. 3(*a*), when the leading edge portion of the recording medium P1 is detected by the leading edge detecting sensor SE1, the information controlling circuit 120 instructs the drive controlling circuit 150 so as to commence the rotating action of the pair of conveyance rollers Q3, and then, the process proceeds to the next step of Step ST10.

In Step ST10, the paper sheet B is conveyed. As aforementioned referring to FIG. 3(*b*), since the information controlling circuit 120 instructs the drive controlling circuit 150 so as to resume the rotating action of the pair of conveyance rollers Q3, the paper sheet B is conveyed towards the merging point, and then, the process proceeds to the next step of Step ST11.

In Step ST11, the paper sheet A and the paper sheet B are overlapped with each other. As aforementioned referring to FIG. 3(*c*), by butting both the leading edge portion of the paper sheet A and the leading edge portion of the paper sheet B against the pair of conveyance rollers Q2 whose rotating action is temporarily stopped, the paper sheet A and the paper sheet B are overlapped with each other in a state that the both leading edge portions of them are aligned to each other, and then, the process proceeds to the next step of Step ST12.

In Step ST12, both the paper sheet A and the paper sheet B are conveyed. Concretely speaking, both the paper sheet A and the paper sheet B are conveyed by the pair of conveyance rollers Q2 in the state that the paper sheet A and the paper sheet B are overlapped with each other while the both leading edge portions of them are aligned to each other.

After that, the predetermined post processing are implemented so as to finalize the consecutive image forming operations from the image forming operation to the post processing operation.

In Step ST13, the copy operation is commenced. Under the instructions outputted from the CPU 110, the image forming apparatus 20 activates the image processing circuit 140 and the drive controlling circuit 150 so as to commence the operations for forming image based on the image information on the paper sheet A, and then, the process proceeds to the next step of Step ST14.

In Step ST14, the paper sheet A is conveyed. Since the insertion mode is not selected, the information controlling circuit 120 controls the drive controlling circuit 150 so as to convey the paper sheet A, on which the image is already formed, towards the post processing apparatus without conducting the operation for making the paper sheet A and the paper sheet B overlap with each other, and then, the process proceeds to the next step of Step ST15.

In Step ST15, the paper sheet B is conveyed. Since the insertion mode is not selected, the information controlling circuit 120 controls the drive controlling circuit 150 so as to convey the paper sheet B towards the post processing apparatus without conducting the operation for making the paper sheet A and the paper sheet B overlap with each other.

After that, the predetermined post processing are applied to the paper sheet A and the paper sheet B, for instance, individually or in the overlapped state, so as to finalize the consecutive image forming operations from the image forming operation to the post processing operation.

As described in the foregoing, in the embodiment of the present invention, in order to provide an image forming apparatus, which makes it possible to improve its productivity, the recording medium and the insertion recording medium are conveyed in an overlapped state when the recording medium data of them correspond to the analogous conditions, while the recording medium and the insertion recording medium are conveyed individually without conducting the overlapping operation when the recording medium data of them do not correspond to the analogous conditions. However, for instance, it is also applicable that a range and/or a combination of the recording medium data, such as a kind, a basis weight, a size, etc., which cannot be established as the analogous conditions, are stored in advance in a storage section in order to display the stored contents of them on the display device when the operator intends to establish the analogous conditions, or to warn the operator when the operator establishes conditions, which cannot be established as the analogous conditions.

Further, in the embodiment of the present invention, since there is provided a recording medium overlapping section, which makes the recording medium, conveyed from the image forming section, and the insertion recording medium, conveyed by the insertion recording-medium conveyance section, overlap each other, and convey them towards the post processing apparatus at a time in the overlapped state, it is possible to drastically shorten the conveyance time, compared to that for the conventional case in which the recording medium and the insertion recording medium are individually conveyed. Accordingly, it becomes possible to provide an image forming apparatus, which makes it possible to easily insert the insertion recording medium and to improve its productivity.

Still further, in the embodiment of the present invention, by butting both the leading edge portion of the recording medium conveyed towards the recording medium overlapping section and the leading edge portion of the insertion recording medium in the conveyance direction against the pair of conveyance rollers, serving as the recording medium overlapping section, the both leading edge portions of them are aligned to each other. Accordingly, it becomes possible to provide the image forming apparatus, which makes the recording medium and the insertion recording medium precisely overlap each other and makes it possible to improve its productivity.

Still further, in the embodiment of the present invention, when the judging section respectively compares the recording medium data of the recording medium with those of the insertion recording medium and determines that the recording medium data correspond to the analogous conditions established in advance, the recording medium and the insertion recording medium are made to overlap each other. Accordingly, it becomes possible to provide an image forming apparatus, which makes it possible to easily insert the insertion recording medium in an overlapped state with the recording medium and to improve its productivity.

Yet further, in the embodiment of the present invention, when the judging section determines that the recording medium data do not correspond to the analogous conditions established in advance, such as a kind of the recording medium, a basis weight, a size, etc., the recording medium and the insertion recording medium are respectively and individually conveyed. Accordingly, it becomes possible to provide an image forming apparatus, which makes it possible to prevent a conveyance defect, such as a jam, etc., caused by the unreasonable overlapping operation of the recording medium and the insertion recording medium, whose recording medium data are different from each other, and to improve its productivity by conducting the effective conveyance operation.

Incidentally, although the copier is exemplified as the embodiment of the present invention in the foregoing, it is needless to say that the present invention can be also applied to a printer, a facsimile and a compound apparatus of them.

What is claimed is:

1. An image forming apparatus comprising:

an image forming section to form an image on a recording medium;

a sheet tray on which an inserting sheet is stacked;

a sheet overlapping section to make the recording medium and the inserting sheet overlap with each other;

a first conveyance section to convey the recording medium from the image forming section to the sheet overlapping section;

a second conveyance section to convey the inserting sheet from the sheet tray to the sheet overlapping section;

a third conveyance section to simultaneously convey the recording medium and the inserting sheet from the sheet overlapping section to a postprocessing section, wherein the post-processing section processes the recording medium and the inserting sheet conveyed by the third conveyance section;

a storage section to store first printing information of the recording medium and second printing information of the inserting sheet;

a setting section to set analogous conditions with respect to the recording medium and the inserting sheet; and a determining section to compare the first printing information of the recording medium with the second printing information of the inserting sheet, so as to determine whether or not the first printing information and the second printing information are analogous to each other, based on the analogous conditions;

wherein the sheet overlapping section makes the recording medium and the inserting sheet overlap with each other, when the determining section determines that the first printing information and the second printing information are analogous to each other.

2. The image forming apparatus of claim 1, wherein the sheet overlapping section comprises:

a pair of rollers to sandwich the recording medium and the inserting sheet; and a controlling section to control rotation of the pair of rollers;

wherein the controlling section stops the rotation of the pair of rollers so as to match leading edges of the recording medium and the inserting sheet with each other.

3. The image forming apparatus of claim 1, wherein the analogous conditions include at least one of a kind of sheet, a basis weight, and a size.

4. The image forming apparatus of claim 1, further comprising:

a designation section to designate a page of the recording medium, wherein the inserting sheet and the designated page of the recording medium are overlapped.

5. An image forming apparatus comprising:

an image forming section to form an image on a recording medium;

a sheet tray on which an inserting sheet is stacked;

a sheet overlapping section to make the recording medium and the inserting sheet overlap with each other;

a first conveyance section to convey the recording medium from the image forming section to the sheet overlapping section;

a second conveyance section to convey the inserting sheet from the sheet tray to the sheet overlapping section;

a storage section to store first printing information of the recording medium and second printing information of the inserting sheet;

a setting section to set analogous conditions with respect to the recording medium and the inserting sheet; and a determining section to compare the first printing information of the recording medium with the second printing information of the inserting sheet, so as to determine whether or not the first printing information and the second printing information are analogous to each other, based on the analogous conditions;

wherein the sheet overlapping section makes the recording medium and the inserting sheet overlap with each other, when the determining section determines that the first printing information and the second printing information are analogous to each other.

6. The image forming apparatus of claim 5, wherein the sheet overlapping section comprises:

a pair of rollers to sandwich the recording medium and the inserting sheet; and a controlling section to control rotation of the pair of rollers;

wherein the controlling section stops the rotation of the pair of rollers so as to match leading edges of the recording medium and the inserting sheet with each other.

7. The image forming apparatus of claim 5, wherein the analogous conditions include at least one of a kind of sheet, a basis weight, and a size.

8. The image forming apparatus of claim 5, further comprising:

a designation section to designate a page of the recording medium, wherein the inserting sheet and the designated page of the recording medium are overlapped.

* * * * *